US006429841B1

(12) United States Patent
Lee

(10) Patent No.: US 6,429,841 B1
(45) Date of Patent: Aug. 6, 2002

(54) ACTIVE MATRIX LIQUID CRYSTAL DISPLAY APPARATUS AND METHOD FOR FLICKER COMPENSATION

(75) Inventor: Hyun Chang Lee, Kumi-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/353,855

(22) Filed: Jul. 15, 1999

(30) Foreign Application Priority Data

Aug. 11, 1998 (KR) ..... 98-32565

(51) Int. Cl.[7] ..... G09G 3/36

(52) U.S. Cl. ..... 345/89; 345/92; 345/94; 345/98; 345/208; 345/690

(58) Field of Search ..... 345/147, 211, 345/58, 87, 88, 89, 90, 100, 208, 690, 691, 94, 92, 98

(56) References Cited

U.S. PATENT DOCUMENTS 5,093,655 A * 3/1992 Tanioka et al. ..... 345/96
5,583,532 A 12/1996 Watanabe ..... 345/89
5,621,439 A * 4/1997 Okada et al. ..... 345/211
5,670,973 A * 9/1997 Bassetti, Jr. et al. ..... 345/58
5,923,310 A * 7/1999 Kim ..... 345/90
6,195,077 B1 * 2/2001 Gyouten et al. ..... 345/99

* cited by examiner

*Primary Examiner*—Lun-Yi Lao
(74) *Attorney, Agent, or Firm*—McKenna Long & Aldridge LLP

(57) ABSTRACT

In active matrix liquid crystal display apparatus that is suitable for eliminating a flicker and a residual image, when a source signal having the same gray level is applied to at least two liquid crystal cells in liquid crystal cells on a liquid crystal panel including the liquid crystal cells arranged in a matrix pattern, source lines and reference voltage lines for applying each liquid crystal cell to an electric field, a difference between a source signal applied to each of at least two liquid crystal cells and a reference voltage signal becomes different. A gamma voltage generator is used to compensate the difference in the applied signal to substantially eliminate the flickering and residual image effects.

13 Claims, 13 Drawing Sheets

ACTIVE MATRIX LIQUID CRYSTAL DISPLAY APPARATUS AND METHOD FOR FLICKER COMPENSATION

This application claims the benefit of Korean Patent Application No. P98-32565, filed on Aug. 11, 1998, which is hereby incorporated by reference.

BACKGROUND OF THE INVENTION

1. Field of the Invention

This invention relates to an active matrix liquid crystal display, and more particularly to an active matrix liquid crystal display apparatus and method having a flicker compensating function as well as a picture uniformity compensating function.

2. Description of the Related Art

The conventional active matrix liquid crystal display device displays a picture by controlling the light transmissivity of liquid crystal using an electric field. The active matrix liquid crystal display device includes a liquid crystal panel having liquid crystal cells arranged in a matrix pattern between two transparent substrates, and a drive circuit for driving the liquid crystal panel. The liquid crystal panel is provided with picture element (or pixel) electrodes and reference electrodes (i.e., common electrodes) for applying an electrical field to each liquid crystal cell. Each pixel electrode is connected, via the source and drain terminals of thin film transistors (TFTs) used as a switching device, to any one source line. The respective gate terminals of the TFTs are connected to gate lines for allowing a pixel voltage signal to be applied to pixel electrodes for one line.

The liquid crystal panel is classified into a longitudinal electric field system and a horizontal electric field system in accordance with a direction of an electric field applied to the liquid crystal cells. The liquid crystal panel of the longitudinal electric field system allows an electrical field applied to the liquid crystal cells to be generated in a direction perpendicular to the transparent substrate. To this end, in the longitudinal electric field system liquid crystal panel, pixel electrodes and reference electrodes are arranged in each of two transparent substrates in such a manner to be opposite to each other. In this case, the reference electrodes are integrally formed in any one of the two transparent substrates.

On the other hand, the horizontal electric field system liquid crystal panel (commonly known as a in-plane switching mode) allows an electric field applied to liquid crystal cells to be generated in a direction parallel to the transparent substrate. Accordingly, in the horizontal electric field system liquid crystal panel, all the pixel electrodes and reference electrodes are positioned at any one of the two transparent substrates. Such a horizontal electric field system liquid crystal panel additionally requires common voltage lines for commonly applying a reference voltage signal to all the reference electrodes, which has a different length depending upon the position of cells on the liquid crystal panel. These common voltage lines CL are arranged in parallel to gate lines GL as shown in FIG. 1 or arranged in parallel to source lines SL as shown in FIG. 2. The liquid crystal panel generates a feedthrough voltage ΔVp corresponding to a voltage different between a source voltage. (i.e., a reference voltage of common electrode) applied to the source line and liquid crystal cell voltage charged in the liquid crystal cell when a scanning signal drops. This feedthrough voltage ΔVp is generated by a parasitic capacitance existing between the gate terminal of the TFT and the liquid crystal cell electrode, and the magnitude of which is varied in accordance with a data signal supplied to the liquid crystal panel to thereby cause a flicker. In other words, the feedthrough voltage ΔVp has a different magnitude depending upon the location of liquid crystal cells.

An example of a liquid crystal display device for overcoming such a disadvantage is disclosed in U.S. Pat. No. 5,583,532 assigned to NEC. The liquid crystal display device described in the above patent is capable of providing a compensation for any one pixel on the liquid crystal panel, but it fails to solve such a problem for the entire liquid crystal panel. In other words, even though a compensation is made on the basis of any one portion of the liquid crystal panel (e.g., the left field), a flicker is still generated at the other portion (e.g., the right field). This is caused by the fact that the magnitude of the generated feedthrough voltage ΔVp is different, depending upon the position of liquid crystal cells when a same magnitude of source voltage signals are applied to the liquid crystal cells. In addition, the feedthrough voltage ΔVp is not only influenced by a time difference of a scanning signal applied to the gate terminals of the TFTs, but it is also influenced by a time difference of a reference voltage signal applied to the reference electrodes. Due to this, a flicker and a residual image still remain in the liquid crystal display device. Moreover, the light transmissivity of liquid crystal cells becomes non-uniform due to the feedthrough voltage ΔVp having a different magnitude depending upon the cells of the liquid crystal panel. As a result, a flicker as well as a residual image appears in a picture displayed on the liquid crystal panel. Further, a picture displayed on the liquid crystal panel is distorted.

Prior to explaining embodiments of the present invention, a cause of problems occurring in the conventional flat display panel device will be described. Each picture element or pixel on the liquid crystal panel has an equivalent circuit as shown in FIG. 3. In FIG. 3, the pixel includes a TFT MN connected among a gate line GL, a source line SL and a reference voltage line CL, and a liquid crystal cell Clc connected between the source terminal of the TFT MN and the reference voltage line CL. In addition, the pixel includes a parasitic capacitance Cgs generated between the source terminal of the TFT MN and the gate line GL, a parasitic resistance Rtft existing between the drain terminal and the source terminal of the TFT MN, and a reference line resistance Rcom existing between the liquid crystal cell Clc and the reference voltage line CL. Herein, the parasitic resistance Rtft is an equivalent resistance when the TFT is off and does not have a constant value.

The liquid crystal cell Clc charges a difference voltage between a source signal voltage on the source line SL and a reference voltage on the reference voltage line CL by means of a scanning signal on the gate line GL, during an interval from a time T0 when the TFT MN is turned on to a time Toff, as shown in FIGS. 4A and 4B. The parasitic capacitance Cgs charges a charge amount Qcgs caused by a difference voltage between a high level gate voltage Vgh and a source voltage on the source line SL, during an interval from a rising edge T0 of the scanning signal to a time point T1 when the scanning signal begins to fall, as shown in FIGS. 4A and 4B.

During an interval from a time T1 when the scanning signal begins to fall into a time Toff when the TFT MN is turned off, a part Qt of the charge amount Qcgs charged in the parasitic capacitance Cgs is discharged into the source terminal and the remaining charge amount is re-distributed to the parasitic capacitance Cgs and the liquid crystal cell Clc. At this time, a charge amount Qc incoming from the parasitic capacitance Cgs to the liquid crystal cell Clc influences a cell voltage charged to the liquid crystal cell Clc (or to a source voltage signal). Herein, a sum of the charge amount Qt incoming to the parasitic resistance Rtft of the TFT MN and the charge amount Qc incoming to the liquid crystal cell Clc is constantly maintained independent of the position of pixels if the source voltage signal, a high level voltage and a low level voltage of the scanning signal, and the reference voltage signal are changed in the same condition with respect to all the pixels.

However, as shown in FIG. 4A, a delay amount of the scanning signal applied to the gate terminal of the TFT MN is small when the pixel is close to the start point of the gate terminal GL; while it becomes great when the pixel is distant from the start point of the gate terminal GL. Also, the resistance Rcom of the reference voltage line CL is small in a pixel which is close to the start point of the reference voltage line CL; while it becomes large in a pixel which is distant from the start point of the reference voltage line CL.

If the resistance Rcom of the reference voltage line CL becomes larger as the position of pixel is more distant from the start point of the reference voltage line CL, even when the delay amount of the scanning signal is constant with respect to all the pixels, then a charge amount Qc induced from the parasitic capacitance Cgs into the liquid crystal cell Clc becomes smaller and a charge amount Qt induced from the parasitic capacitance Cgs into the parasitic resistance Rtft of the TFT MN becomes greater as the position of pixel is more distant from the start point of the reference voltage line CL.

Due to this, a feedthrough voltage $\Delta Vp$ becomes smaller as the position of pixel is more distant from the start point of the reference voltage line CL. Further, if a delay amount of the scanning signal becomes larger as the position of pixel is more distant from the start point of the gate line GL, even when the resistance Rcom of the reference voltage line CL has a constant and large value at all the pixels, then a charge amount Qc induced from the parasitic capacitance Cgs into the liquid crystal cell Clc becomes smaller and a charge amount Qt induced from the parasitic capacitance Cgs into the parasitic resistance Rtft of the TFT MN becomes greater as the position of pixel is more distant from the start point of the gate line GL.

As a result, the feedthrough voltage $\Delta Vp$ becomes smaller as the position of pixel is more distant from the start point of the gate line GL. In other words, the feedthrough voltage $\Delta Vp$ becomes smaller as a delay time of the scanning signal is longer and the resistance of the reference voltage line CL is larger.

As described above, the feedthrough voltage $\Delta Vp$ becomes different depending on both a distance between the start point of the gate line GL and the position of pixel and a distance between the start point of the reference voltage line CL and the position of pixel. Due to this, even though the source voltage signal or the reference voltage signal is compensated on the basis of a certain position on the liquid crystal panel, a flicker as well as a residual image still remains at various positions on the liquid crystal panel. As a result, the conventional active matrix liquid crystal display device cannot avoid a distortion of the displayed picture.

SUMMARY OF THE INVENTION

Accordingly, it is an object of the present invention to provide a liquid crystal display apparatus and method that is adapted to eliminate a flicker as well as a residual image.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve this and other objects of the invention, a liquid crystal display apparatus according to one aspect of the present invention includes a liquid crystal panel having liquid crystal cells arranged in a matrix pattern and source lines and reference voltage lines for applying each liquid crystal cell to an electric field, and means for allowing a difference between a positive and negative data center value of a source signal applied to each of at least two liquid crystal cells in the liquid crystal cell and a reference voltage signal when a source signal having the same gray level is applied to said at least two liquid crystal cells to have a different value.

A display method for said liquid crystal display apparatus according to another aspect of the present invention includes allowing a difference between a positive and negative data center value of a source signal applied to each of at least two liquid crystal cells in the liquid crystal cell and a reference voltage signal when a source signal having the same gray level is applied to said at least two liquid crystal cells having a different value.

A liquid crystal display apparatus according to yet another aspect of the present invention includes liquid crystal cells arranged in a matrix pattern, source lines for applying each liquid crystal cell to an electric field, a reference electrode opposed the cell matrix, and means for allowing a difference between a center voltage level of a source signal applied to each of at least two liquid crystal cells in the liquid crystal cell and a reference voltage signal when a source signal having the same gray level is applied to said at least two liquid crystal cells having a different value.

A display method for said liquid crystal display apparatus according to still another aspect of the present invention includes allowing a difference between a center voltage level of a source signal applied to each of at least two liquid crystal cells in the liquid crystal cell and a reference voltage signal when a source signal having the same gray level is applied to said at least two liquid crystal cells having a different value. It is to be understood that both the foregoing general description and the following detailed description are exemplary and explanatory and are intended to provide further explanation of the invention as claimed.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 1:
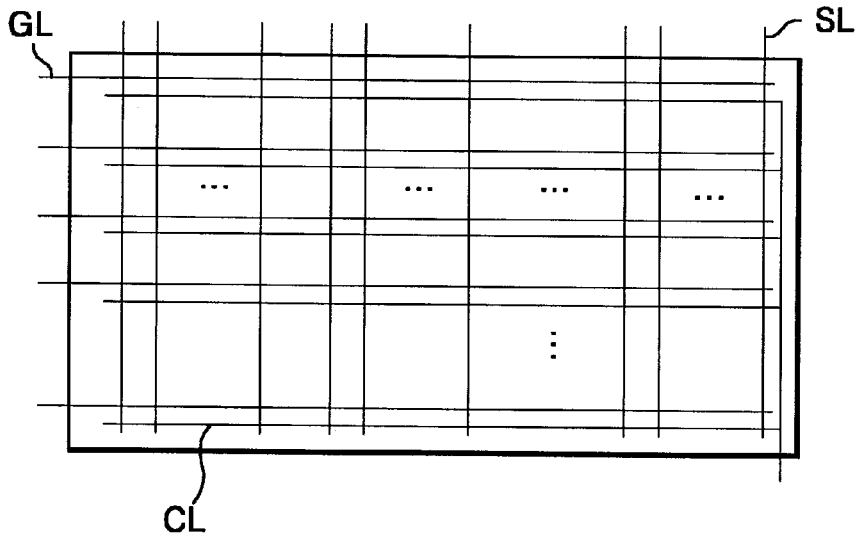
FIG. 1 PRIOR ART
FIG. 1 is a schematic view showing the configuration of a horizontal electric field system liquid crystal display panel in which common voltage lines are formed in parallel to gate lines.
Figure 2:
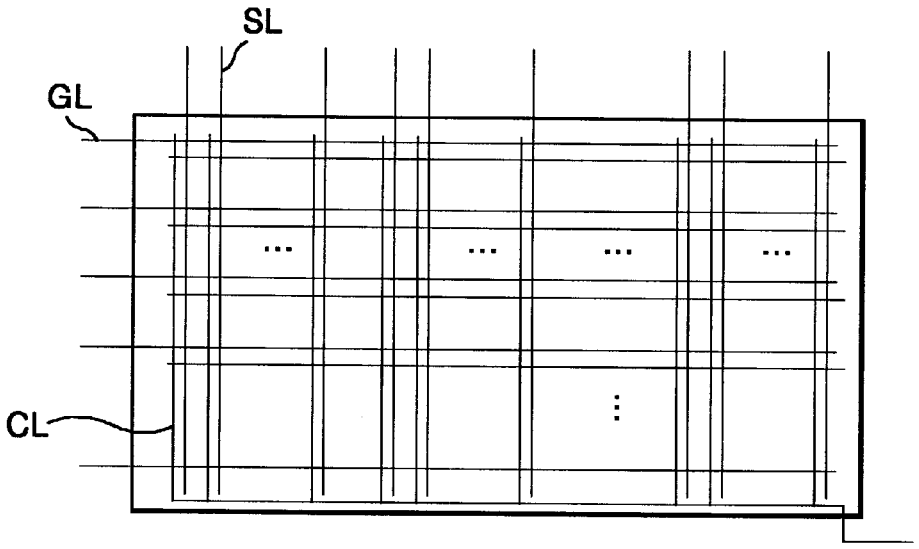
FIG. 2 PRIOR ART
FIG. 2 is a schematic view showing the configuration of a horizontal electric field system liquid crystal display panel in which common voltage lines are formed in parallel to source lines.
Figure 3:
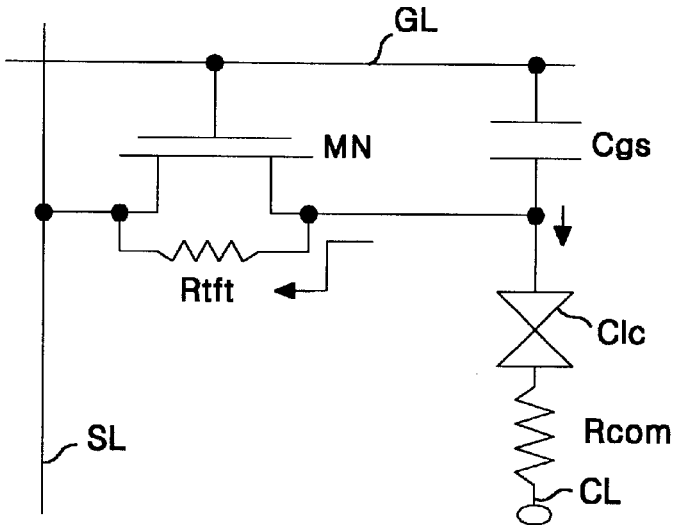
FIG.3 PRIOR ART
FIG. 3 is an equivalent circuit diagram of a pixel formed on a liquid crystal panel.
Figure 4A:
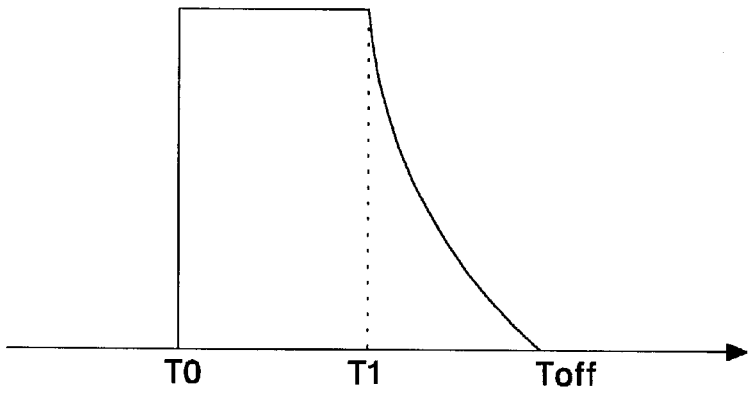
FIG.4A PRIOR ART
FIG. 4A and FIG. 4B are waveform diagrams of a scanning pulse applied to the gate terminal of a TFT close to a start point of the gate line and a scanning pulse applied to the gate terminal of a TFT distant from the start point of the gate line, respectively.
Figure 4B:
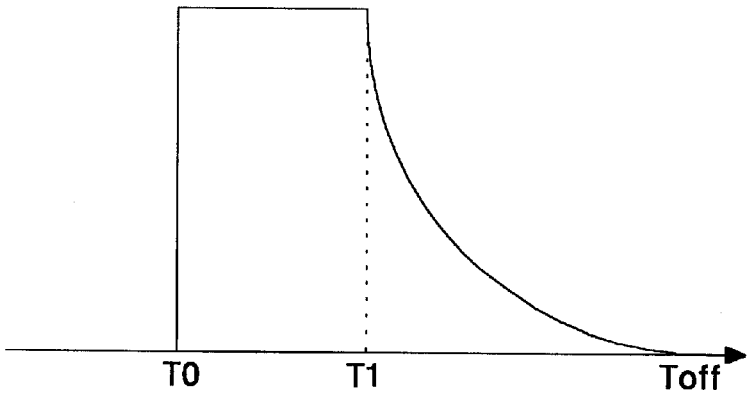
FIG.4B PRIOR ART
Figure 5:
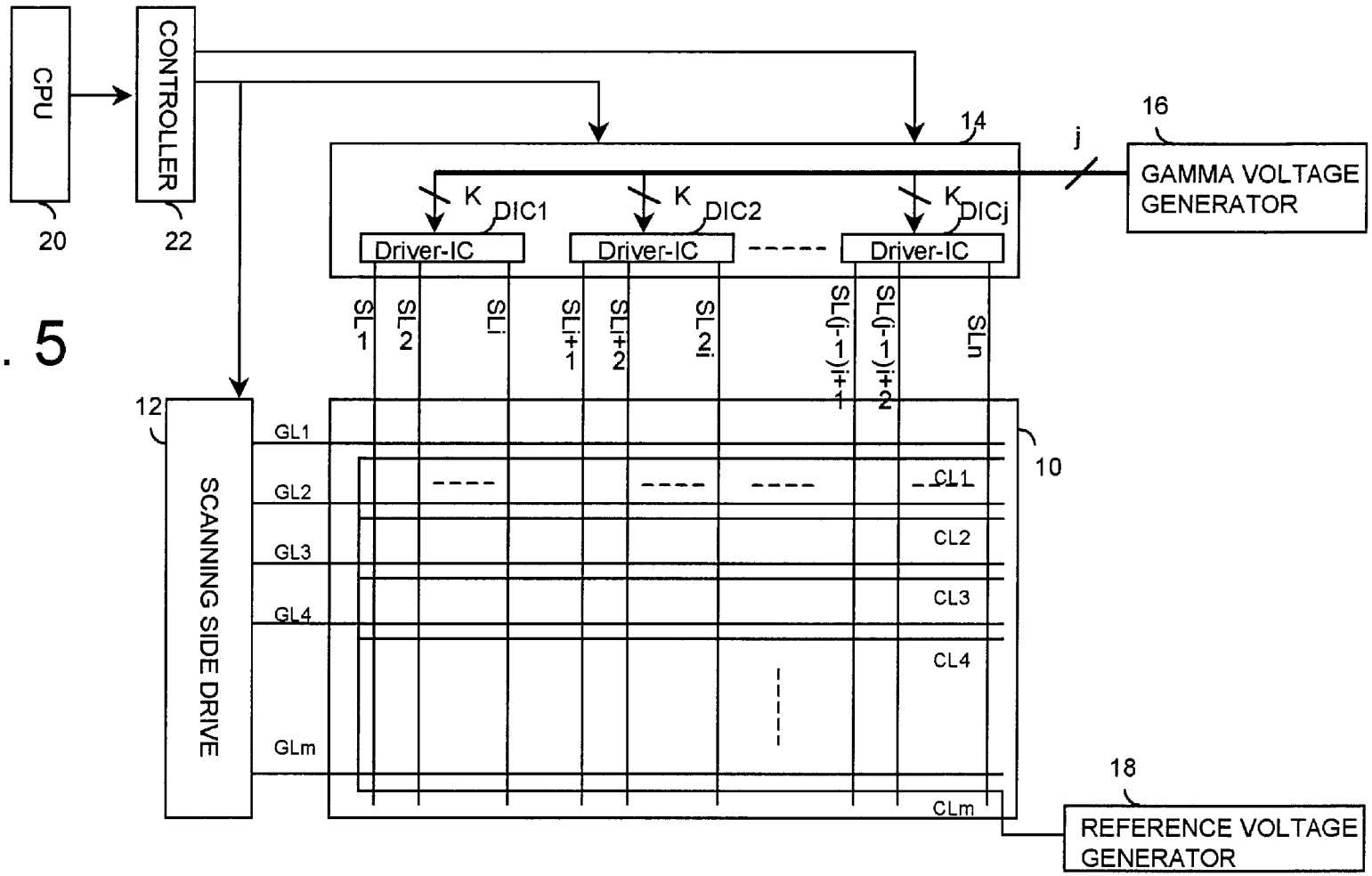
FIG. 5 is a schematic view showing the configuration of an active matrix liquid crystal display apparatus according to a first embodiment of the present invention.

Preferred embodiments of the present invention for preventing such a picture distortion will be described in detail with reference to FIG. 5 to FIG. 10 below. FIG. 5 is a schematic view of a liquid crystal display apparatus with a flicker elimination function according to a first embodiment of the present invention. In FIG. 5, the liquid crystal display apparatus includes a horizontal electric field system liquid crystal panel 10 in which gate lines GL1 to GLm are crossed with source lines SL1 to SLn and reference voltage lines CL1 to CLm is parallel to the gate lines GL1 to GLm. Pixel electrodes (not shown) are connected, via the source terminals and the drain terminals of TFTs, to the source line SL1 to SLn, respectively. The gate terminals of the TFTs are connected to the gate line GL1 to GLm, respectively. Reference electrodes are connected to the reference voltage lines CL1 to CLn, respectively. The reference electrodes and the pixel electrodes apply a horizontal electric field to the liquid crystal cells.

The liquid crystal display apparatus further includes a gate side drive circuit 12 connected to the gate lines GL1 to GLm, and a data side drive circuit 14 connected to the source lines SL1 to SLn. The gate side drive circuit 12 sequentially applies a scanning signal to m gate lines GL1 to GLm to drive pixels on the liquid crystal panel 10 sequentially for one line.

Figure 6:
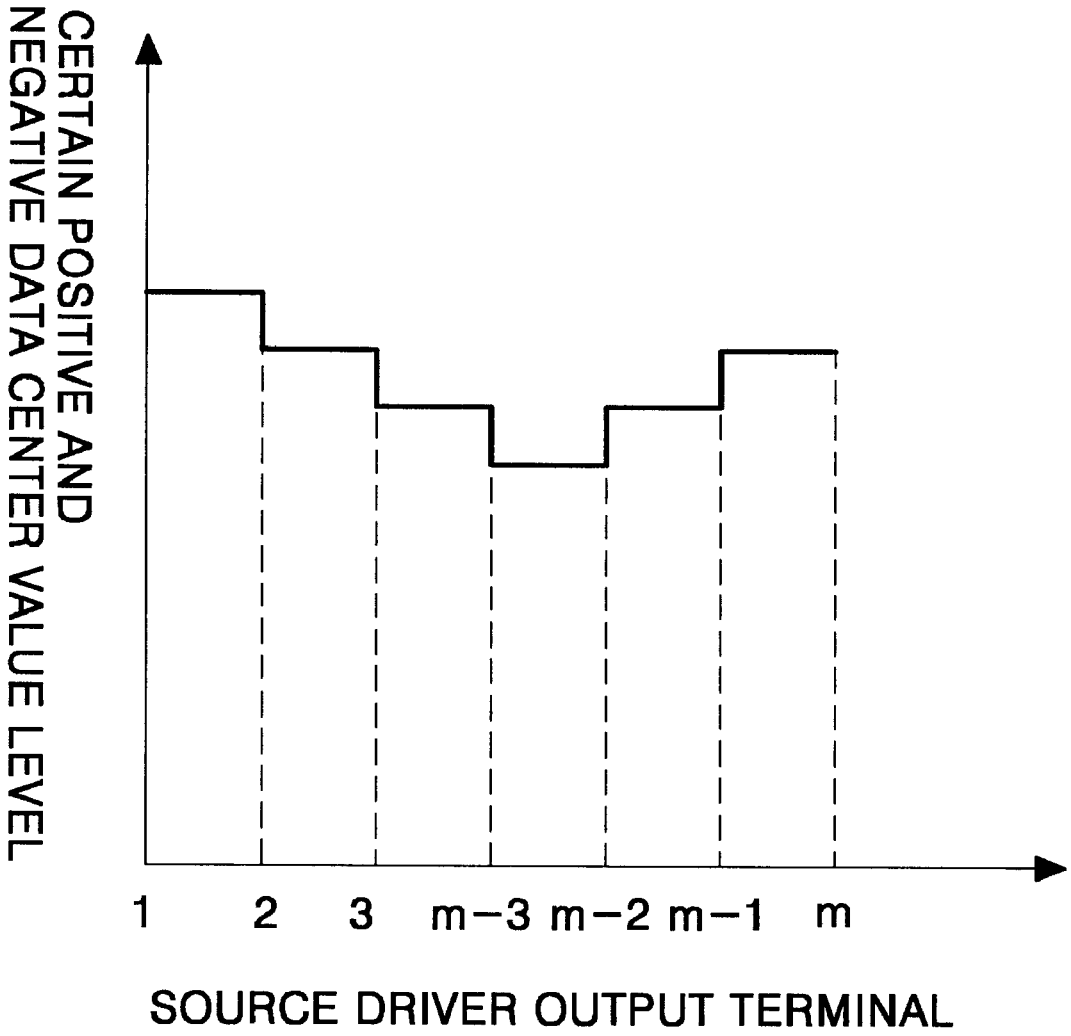
FIG. 6 is a graph showing a change in a center voltage level between positive(+) and negative(−) source signals applied from the data side drive circuit in FIG. 5 for each source line group.

The data side drive circuit 14 applies a source voltage signal to each of n source lines SL1 to SLn each time the scanning signal is applied to any one of the gate lines GL1 to GLm. Further, the data side drive circuit 14 divides the n source lines SL1 to SLn into j line groups, each including i source lines. The data side drive circuit 14 allows a center voltage level between the positive(+) and negative(−) source signals expressing a certain amount of gray levels to become gradually smaller before larger as shown in FIG. 6 as it goes from the first line group to the jth line group.

The data side drive circuit 14 includes j source driver integrated circuits(ICs) DIC1 to DICj that are connected to the j source line groups, respectively, to divisionally receive j gamma voltage signal sets from a gamma voltage generator 16. Each j gamma voltage signal set consists of k gamma voltage signals which are set to have a gradually lower value before a gradually higher value as it goes from the first gamma voltage set to the jth gamma voltage set, that is, depending upon the source driver ICs DIC1 to DICj.

Figure 12:
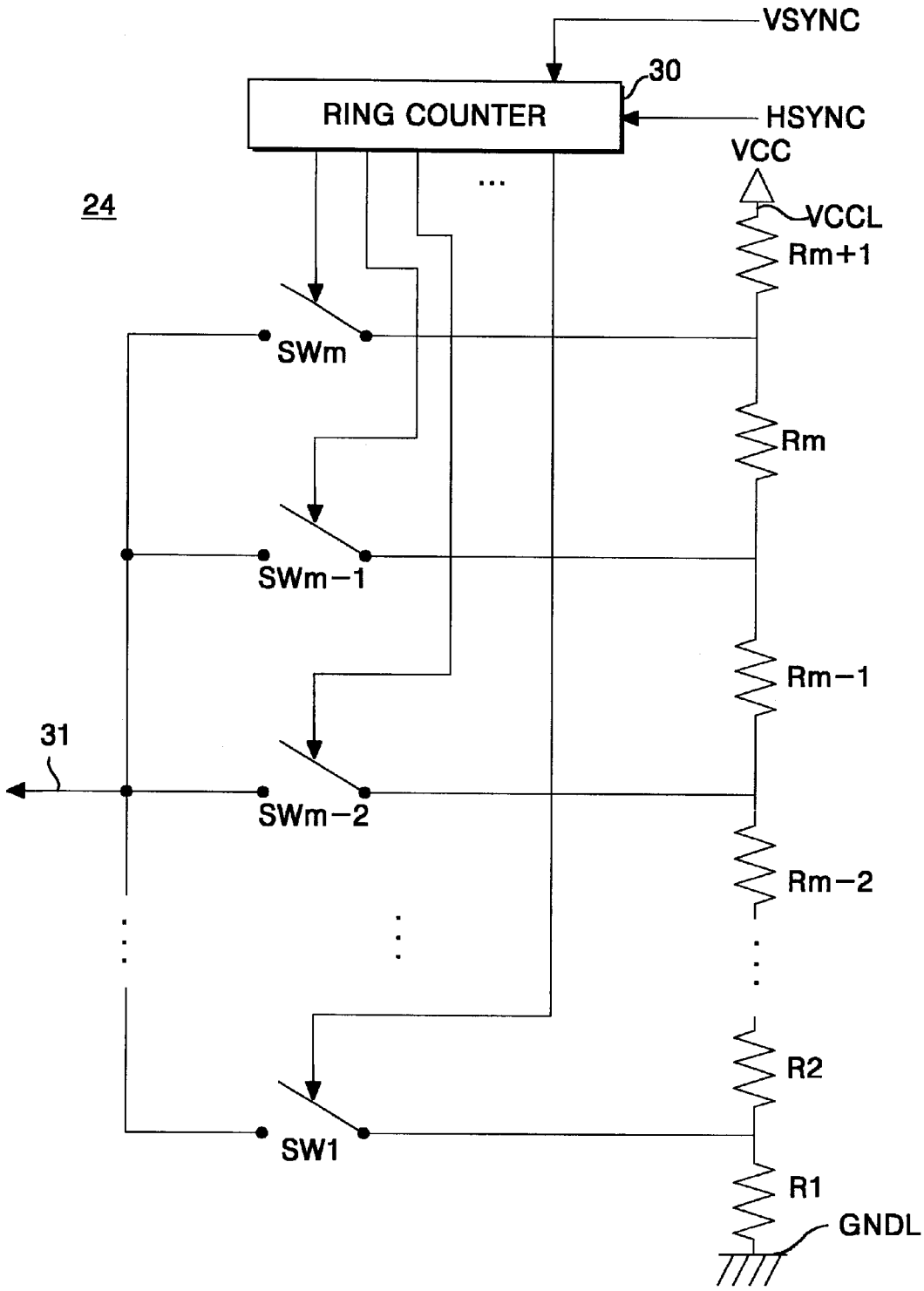
FIG. 12 is a circuit diagram of the variable reference voltage generators as shown in FIG. 8.

In order to generate the j gamma voltage sets, the gamma voltage generator 16 includes j gamma voltage generating cells for each generating k gamma voltage signals. The j gamma voltage sets have both decreasing and increasing characteristics, when they are sequentially applied from each side. Each the gamma voltage generating cells can be consisted of as shown in FIG. 12. As described above, the respective j source driver ICs DIC1 to DICj divisionally receiving the gamma voltage sets having different voltage level steps generate a source signal in which the center voltage level between the positive(+) and negative(−) voltage levels gradually decreases and increases, with respect to a video data having the same logical value. In other words, when the same logical value of data is displayed for all the pixels on the lines, the center voltage level between the positive(+) and negative(−) source signals applied from the first source driver IC DIC1 to the first source line group SL1 to SLi becomes higher than the center voltage levels of source signals applied to other source line groups SLi+1 to SLn. The center voltage level between the positive(+) and negative(−) source signals applied from the second source driver IC DIC2 to the second source line group SLi+1 to SL2i becomes lower than the center voltage level between the positive(+) and negative(−) source signals applied to the first source line group SL1 to SLi and higher than the center voltage level between the positive(+) and negative(−) source signals applied to the third source line group SL2i+1 to SL3i. The center voltage level between the positive(+) and negative(−) source signals applied from the jth source driver IC DICj to the jth source line group SL(j−1)i+1 to SLn becomes higher than the center voltage levels of source signals applied to other source line groups SL(j−2)i+1 to SL(j−1)i. The center voltage level between the positive(+) and negative(−) source signals applied from the jth source driver IC DICj to the jth source line group SL(J−2)i+1 to SL(j−1)i becomes higher than the center voltage levels of source signals applied to other source line groups SL(J−3)i+1 to SL(j−2)i.

As a result, the center voltage level between the positive (+) and negative(−) source signals generating at each j source driver IC DIC1 to DICj becomes gradually lower before higher as it goes from the first line group SL1 to SLi to the jth line group SL(j−1)i+1 to SLn. These j source driver ICs compensate for a difference in the feedthrough voltage $\Delta Vp$ generated at a picture for one line due to a delay of scanning signal at the gate line GL.

Furthermore, the liquid crystal display apparatus includes a reference voltage generator 18 commonly connected to the reference voltage lines CL1 to CLn, a central processing unit(CPU) 20 for processing an image data, and a controller 22 connected among the CPU 20, the scanning side drive circuit 12 and the data side drive circuit 14. The reference voltage generator 18 commonly applies a reference voltage signal to all the n reference voltage lines CL1 to CLm. The reference voltage signal generated at the reference voltage generator 18 has a constant voltage level.

As shown in FIG. 5, CPU 20 supplies the processed image data to the controller 22. Then, the controller 22 supplies the image data from the CPU 20 commonly to the j source driver ICs DIC1 to DICj within the data side drive circuit 14 and, simultaneously, supplies various timing signals to the scanning side drive circuit 12 and the source driver ICs DIC1 to DICj within the data side drive circuit 14. Accordingly, each source driver IC DIC1 to DICj converts video data from the controller 22 into a positive (+) or negative (−) source signal having an analog signal shape with the aid of the gamma voltage sets from the gamma voltage generator 16 and applies the converted source signal to the source line SL.

Figure 7:
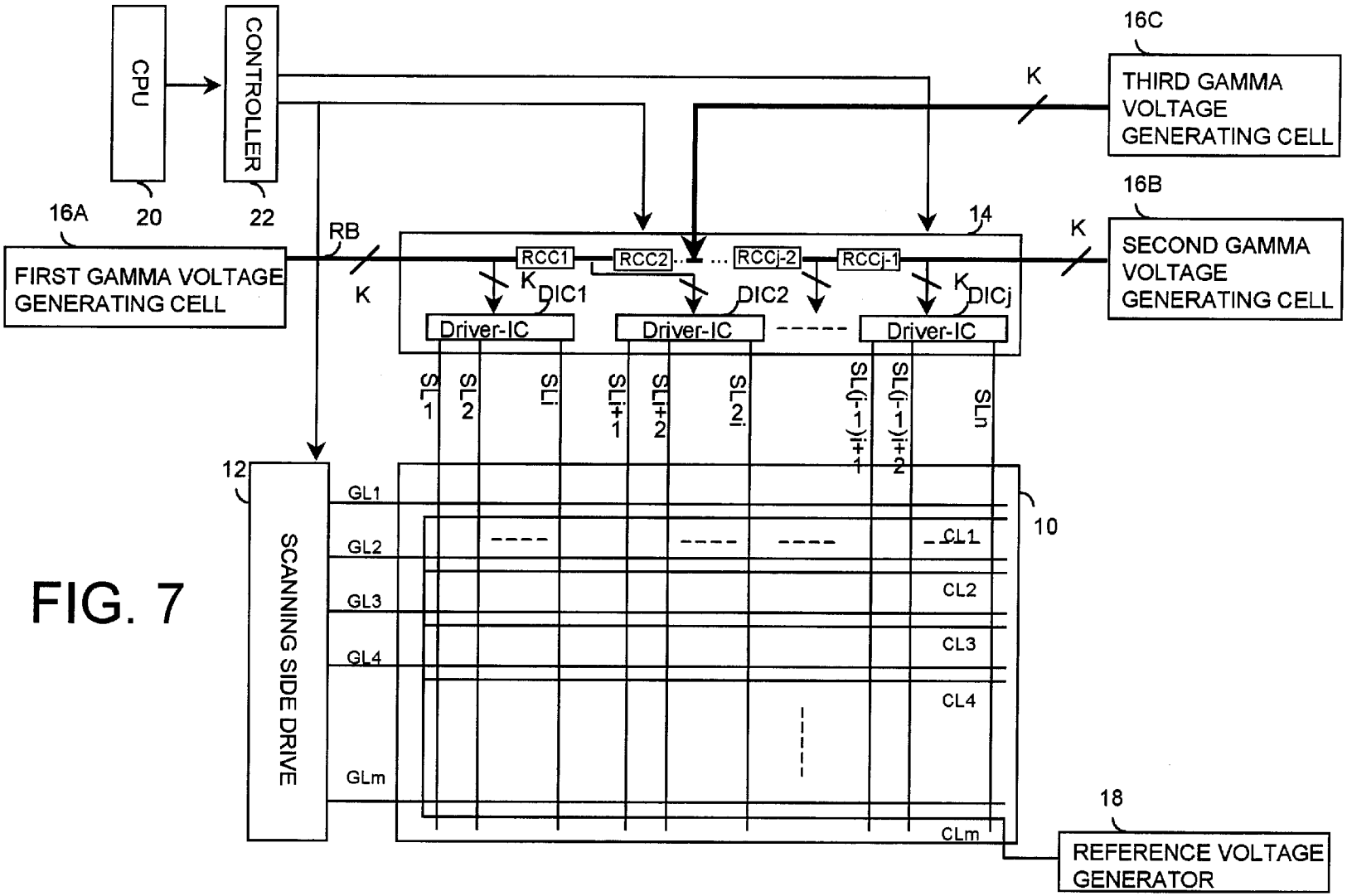
FIG. 7 is a schematic view showing the configuration of an active matrix liquid crystal display apparatus according to a second embodiment of the present invention.

FIG. 7 is a schematic view of a liquid crystal display apparatus with a flicker elimination function according to a second embodiment of the present invention. In FIG. 7, the liquid crystal display apparatus includes a horizontal electric field system liquid crystal panel 10 in which gate lines GL1 to GLm are crossed with source lines SL1 to SLn and reference voltage lines CL1 to CLm is parallel to the gate lines GL1 to GLm. Pixel electrodes (not shown) are connected, via the source terminals and the drain terminals of TFTs, to the source line SL1 to SLn, respectively. The gate terminals of the TFTs are connected to the gate line GL1 to GLn, respectively. Reference electrodes are connected to the reference voltage lines CL1 to CLn, respectively. The reference electrodes and the pixel electrodes apply a horizontal electric field to the liquid crystal cells.

The liquid crystal display apparatus further includes a gate side drive circuit 12 connected to the gate lines GL1 to GLm, and a data side drive circuit 14 connected to the source lines SL1 to SLn. The gate side drive circuit 12 sequentially applies a scanning signal to m gate lines GL1 to GLm to drive pixels on the liquid crystal panel 10 sequentially for one line.

The data side drive circuit 14 applies a source voltage signal to each of n source lines SL1 to SLn each time the scanning signal is applied to any one of the gate lines GL1 to GLm. Further, the data side drive circuit 14 divides the n source lines SL1 to SLn into j line groups, each including i source lines. The data side drive circuit 14 allows a center voltage level between the positive(+) and negative(−) source signals expressing a certain amount of gray levels to become gradually smaller before larger as shown in FIG. 6 as it goes from the first line group to the jth line group.

The data side drive circuit 14 includes j source driver integrated circuits(ICs) DIC1 to DICj that are connected to the j source line groups, respectively, to divisionally receive j gamma voltage signal sets from a resistor bus RB. The resistor bus RB is provided with (j−1) resistor circuits RCC1 to RCCj−1 connected to each other. Both end of the resistor bus RB are connected to a first gamma voltage generating cell 16A and a second gamma voltage generating cell 16B, respectively. Also, the middle point of the resistor bus RB receives a third gamma voltage signal set from a third gamma voltage generating cell 16C. The first gamma voltage generating cell 16A generates a first gamma voltage signal set to be applied to one end of the resistor bus RB and the first source driver IC DIC1. Similarly, the second gamma voltage generating cell 16B provides a second gamma voltage signal set to be supplied to another end of the resistor bus line RBL and the j source driver IC DICj. Each the 3gamma voltage signal set consists of k gamma voltage signals. The first gamma voltage signal set has a voltage level equal to that of the second gamma voltage signal set. Whereas, the voltage level of the third gamma voltage signal is lower than them of the first and second gamma voltage signal sets. The gamma voltage generating cells 16A to 16C each have a circuit structure as shown FIG. 13. Each the resistor circuit RCC1 to RCCj−1 includes k resistors, and the resistor bus consists of k resistor lines. The resistor bus RB divides the first to third gamma voltage signal sets to produce j gamma voltage signal sets. Each j gamma voltage signal set is set to have a gradually lower value before a gradually higher value as it goes from the first gamma voltage set to the jth gamma voltage set, that is, depending upon the source driver ICs DIC1 to DICj. Also, the source driver ICs DIC2 to DICj−1 receives the gamma voltage signal set from each the connecting point between the resistor circuits RCC1 to RCCj−1. On the other hand, the resistor bus RB can divide the first and second gamma voltage signal sets and generate the j gamma voltage signal sets. In this case, the third gamma voltage generating cell 16C is eliminated.

As described above, the respective j source driver ICs DIC1 to DICj divisionally receiving the gamma voltage sets having different voltage level steps generate a source signal in which the center voltage level between the positive(+) and negative(−) voltage levels gradually decreases and increases, with respect to a video data having the same logical value. In other words, when the same logical value of data is displayed for all the pixels on the lines, the center voltage level between the positive(+) and negative(−) source signals applied from the first source driver IC DIC1 to the first source line group SL1 to SLi becomes higher than the center voltage levels of source signals applied to other source line groups SLi+1 to SLn. The center voltage level between the positive(+) and negative(−) source signals applied from the second source driver IC DIC2 to the second source line group SLi+1 to SL2i becomes lower than the center voltage level between the positive(+) and negative(−) source signals applied to the first source line group SL1 to SLi and higher than the center voltage level between the positive(+) and negative(−) source signals applied to the third source line group SL2i+1 to SL3i. The center voltage level between the positive(+) and negative(−) source signals applied from the jth source driver IC DICj to the jth source line group SL(j−1)i+1 to SLn becomes higher than the center voltage levels of source signals applied to other source line groups SL(j−2)i+1 to SL(j−1)i. The center voltage level between the positive(+) and negative(−) source signals applied from the jth source driver IC DICj to the jth source line group SL(j−2)i+1 to SL(j−1)i becomes higher than the center voltage levels of source signals applied to other source line groups SL(j−3)i+1 to SL(j−2)i.

As a result, the center voltage level between the positive (+) and negative(−) source signals generating at each j source driver IC DIC1 to DICj becomes gradually lower before higher as it goes from the first line group SL1 to SLi to the jth line group SL(j−1)i+1 to SLn. These j source driver ICs compensate for a difference in the feedthrough voltage $\Delta Vp$ generated at a picture for one line due to a delay of scanning signal at the gate line GL.

Furthermore, the liquid crystal display apparatus includes a reference voltage generator 18 commonly connected to the reference voltage lines CL1 to CLn, a central processing unit(CPU) 20 for processing an image data, and a controller 22 connected among the CPU 20, the scanning side drive circuit 12 and the data side drive circuit 14. The reference voltage generator 18 commonly applies a reference voltage signal to all the n reference voltage lines CL1 to CLm. The reference voltage signal generated at the reference voltage generator 18 has a constant voltage level.

As shown in FIG. 7, CPU 20 supplies the processed image data to the controller 22. Then, the controller 22 supplies the image data from the CPU 20 commonly to the j source driver ICs DIC1 to DICj within the data side drive circuit 14 and, simultaneously, supplies various timing signals to the scanning side drive circuit 12 and the source driver ICs DIC1 to DICj within the data side drive circuit 14. Accordingly, each source driver IC DIC1 to DICj converts video data from the controller 22 into a positive (+) or negative (−) source signal having an analog signal shape with the aid of the gamma voltage sets from the gamma voltage generator 16 and applies the converted source signal to the source line SL.

Figure 8:
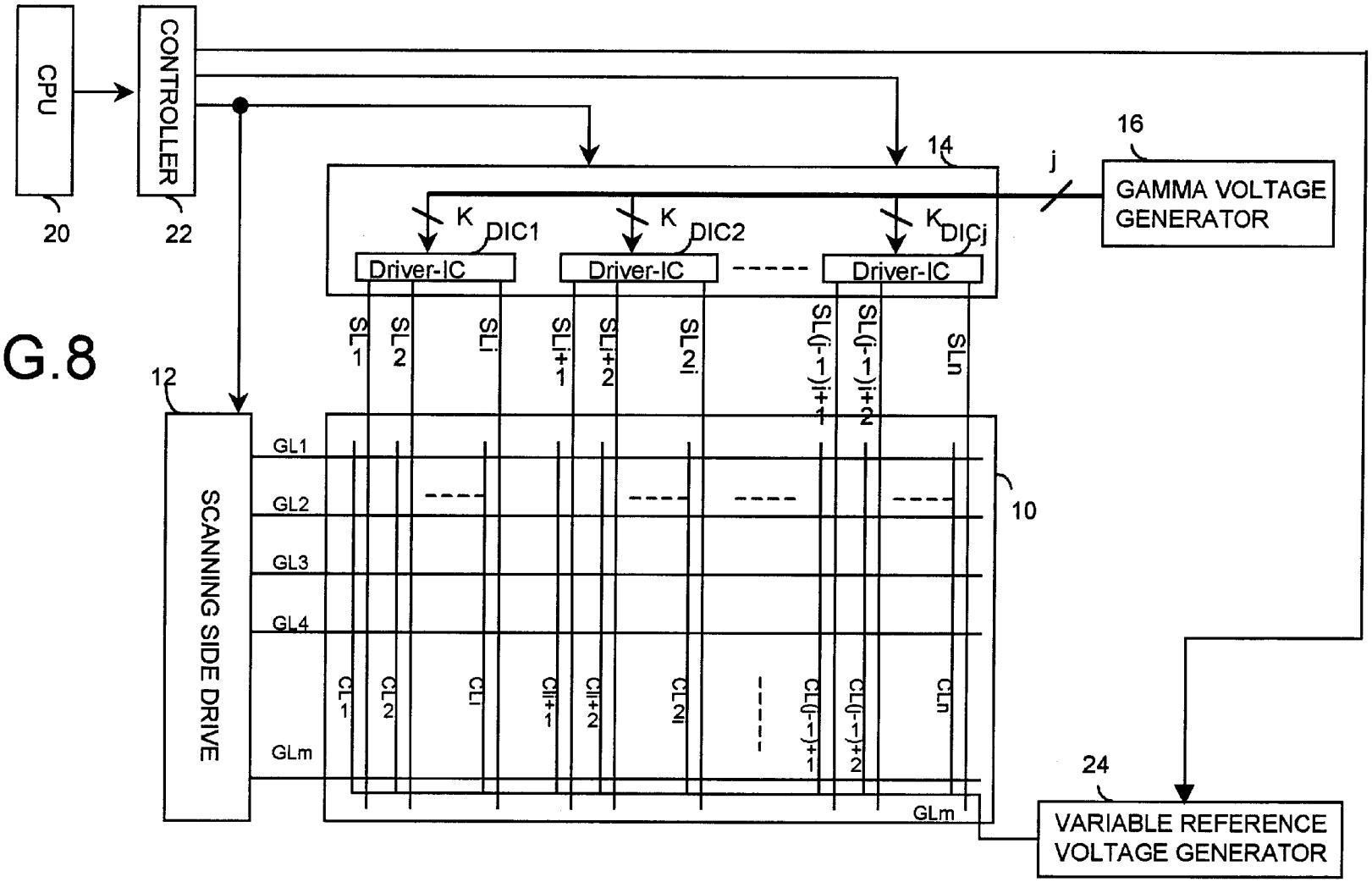
FIG. 8 is a schematic view showing the configuration of an active matrix liquid crystal display apparatus according to a third embodiment of the present invention.

FIG. 8 is a schematic view of a liquid crystal display apparatus with a flicker elimination function according to a third embodiment of the present invention. In FIG. 8, the liquid crystal display apparatus includes a horizontal electric field system liquid crystal panel 10 in which gate lines GL1 to GLm are crossed with source lines SL1 to SLn and reference voltage lines CL1 to CLn are parallel to the source lines SL1 to SLn. Pixel electrodes (not shown) are connected, via the source terminals and the drain terminals of TFTs, to the source line SL1 to SLn, respectively. The gate terminals of the TFTs are connected to the gate line GL1 to GLm, respectively. Reference electrodes are connected to the reference voltage lines CL1 to CLn, respectively. The reference electrodes and the pixel electrodes apply a horizontal electric field to the liquid crystal cells.

The liquid crystal display apparatus further includes a gate side drive circuit 12 connected to the gate lines GL1 to GLm, and a data side drive circuit 14 connected to the source lines SL1 to SLn. The gate side drive circuit 12 sequentially applies a scanning signal to m gate lines GL1 to GLm to drive pixels on the liquid crystal panel 10 sequentially for one line.

The data side drive circuit 14 applies a source voltage signal to each of n source lines SL1 to SLn each time the scanning signal is applied to any one of the gate lines GL1 to GLm. Further, the data side drive circuit 14 divides the n source lines SL1 to SLn into j line groups, each including i source lines. The data side driving circuit 14 allows a center voltage level between the positive(+) and negative(−) source signals expressing a certain amount of gray levels to become gradually smaller and larger as shown in FIG. 6 as it goes from the first line group to the jth line group. The data side drive circuit 14 includes j source driver integrated circuits (ICs) DIC1 to DICj that are connected to the j source line groups, respectively, to divisionally receive j gamma voltage signal sets from a gamma voltage generator 16. Each j gamma voltage signal set consists of k gamma voltage signals which are set to have a gradually lower value before a gradually higher value as it goes from the first gamma voltage set to the jth gamma voltage set, that is, depending upon the source driver ICs DIC1 to DICj.

In order to generate the j gamma voltage sets, the gamma voltage generator 16 consists of j gamma voltage generating cells for each generating k gamma voltage signals. As described above, the respective j source driver ICs DIC1 to DICj divisionally receiving the gamma voltage sets having different voltage level steps generate a source signal in which the center voltage level between the positive(+) and negative(−) voltage levels becomes gradually decreasing and increasing, with respect to a video data having the same logical value. In other words, when the same logical value of data is displayed for all the pixels on the lines, the center voltage level between the positive(+) and negative(−) source signals applied from the first source driver IC DIC1 to the first source line group SL1 to SLi becomes higher than the center voltage levels of source signals applied to other source line groups SLi+1 to SLn. The center voltage level between the positive(+) and negative(−) source signals applied from the second source driver IC DIC2 to the second source line group SLi+1 to SL2i becomes lower than the center voltage level between the positive(+) and negative(−) source signals applied to the first source line group SL1 to SLi and higher than the center voltage level between the positive(+) and negative(−) source signals applied to the third source line group SL2i+1 to SL3i. The center voltage level between the positive(+) and negative(−) source signals applied from the jth source driver IC DICj to the jth source line group SL(j−1)i+1 to SLn becomes higher than the center voltage levels of source signals applied to other source line groups SL(j−2)i+1 to SL(j−1)i. The center voltage level between the positive(+) and negative(−) source signals applied from the jth source driver IC DICj to the jth source line group SL(j−2)i+1 to SL(j−1)i becomes higher than the center voltage levels of source signals applied to other source line groups SL(j−3)i+1 to SL(j−2)i.

As a result, the center voltage level between the positive (+) and negative(−) source signals generating at each j source driver IC DIC1 to DICj becomes gradually lower and higher as it goes from the first line group SL1 to SLi to the jth line group SL(j−1)i+1 to SLn. These j source driver ICs compensate for a difference in the feedthrough voltage ΔVp generated at a picture for one line due to a delay of scanning signal at the gate line GL.

Furthermore, the liquid crystal display apparatus includes a variable reference voltage generator 24 commonly connected to the reference voltage lines CL1 to CLn, a central processing unit(CPU) 20 for processing an image data, and a controller 22 connected among the CPU 20, the scanning side drive circuit 12 and the data side drive circuit 14. The variable reference voltage generator 24 applies a reference voltage signal commonly to all the n reference voltage lines CL1 to CLn.

Figure 9A:
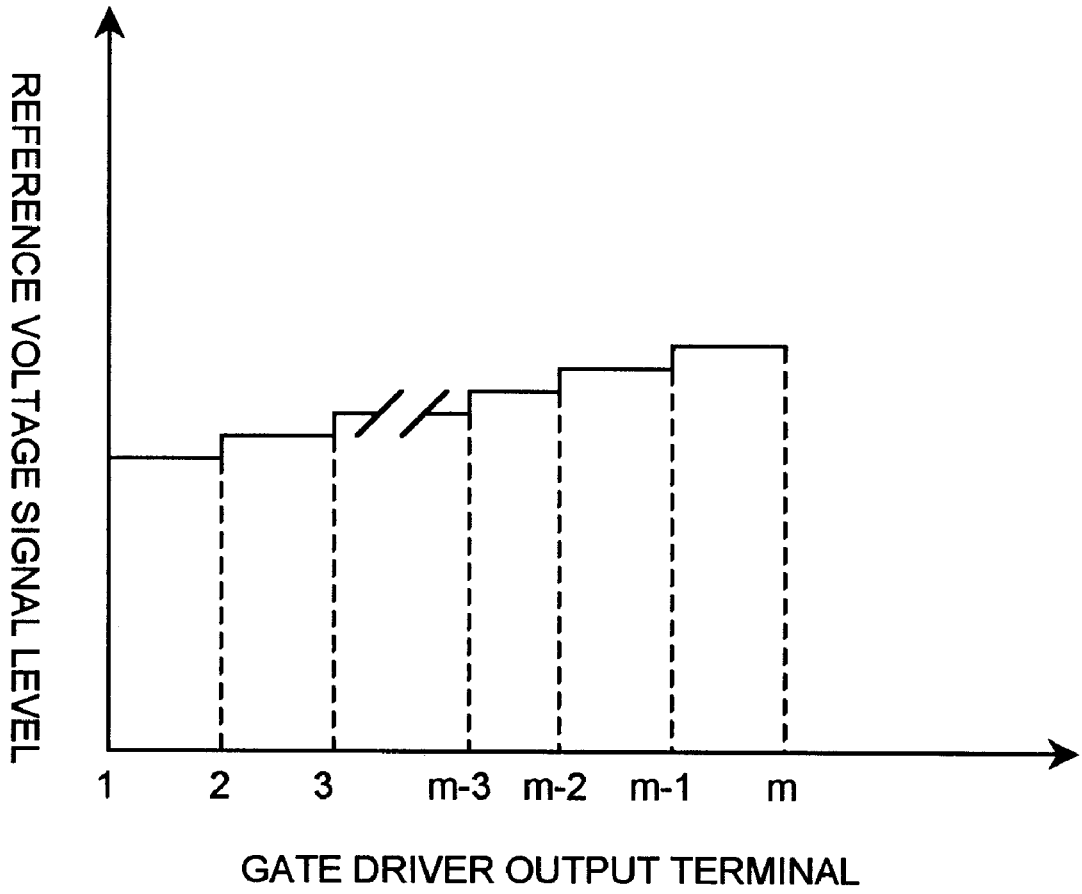
FIG. 9A to FIG. 9C are graphs showing the characteristic of a reference voltage signal output from the reference voltage generator in FIG. 8.
Figure 9B:
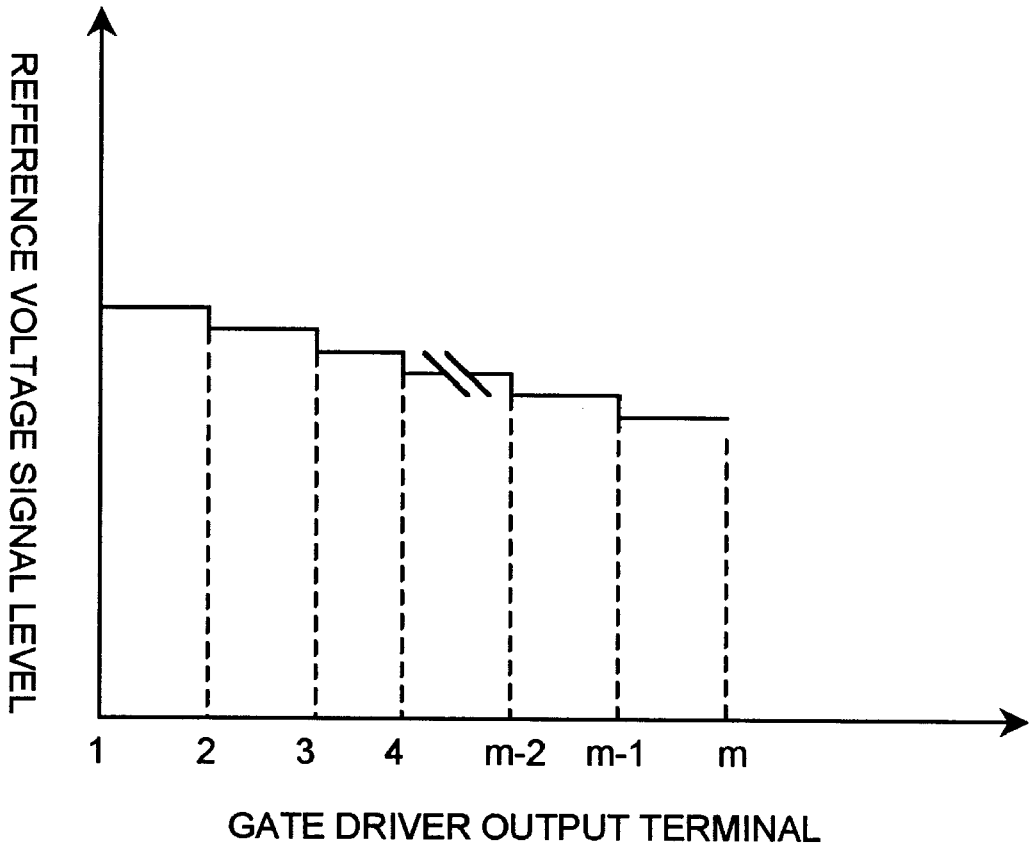
Figure 9C:
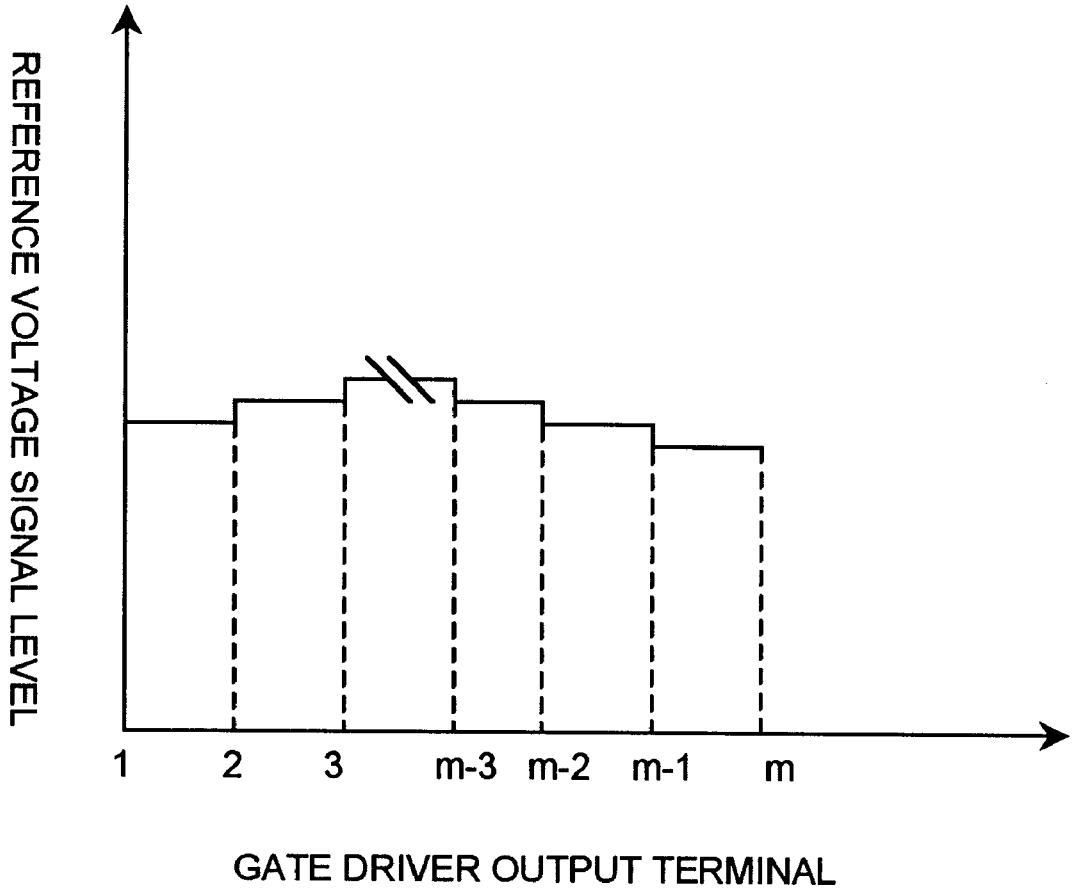

The reference voltage signal generated at the variable reference voltage generator 24 changes gradually as shown in FIGS. 9A to 9C as the m gate lines GL1 to GLm are sequentially enabled. The reference voltage signal gradually increases as seen from FIG. 9A when it is applied from the source signal input stage; while it gradually decreases as seen from FIG. 9B when it is applied from a side opposed to the source signal input stage. Further, the reference voltage signal has both increasing and decreasing characteristics, as seen from 9C, when it is applied from each side. When the reference voltage generator is connected to substantially a middle location of the shared line of FIG. 8, it generates lower reference voltages as gate lines that are spatially farther away from the middle location are enabled. A voltage level of the reference voltage signal changes gradually in the above manner depending upon the gate lines GL1 to GLm, thereby compensating for a difference of the feedthrough voltages ΔVp at the pixels connected to a certain source line SL.

As described above, the center value of positive and negative data in the source signal becomes gradually low and high depending upon the source lines SL, so that the feedthrough voltages ΔVp at all the pixels on the liquid crystal panel 10 become equal to each other and voltages applied to each liquid crystal pixel become the same with respect to a video data having the same gray level (i.e., the same logical value). Accordingly, a flicker and a residual image does not appear at the liquid crystal panel 10 and, furthermore, a picture is not distorted.

As described above, the center value of positive and negative data in the source signal becomes gradually low and high depending upon the source lines SL and the voltage level of the reference voltage signal changes gradually depending upon the gate lines GL, so that the feedthrough voltages ΔVp at all the pixels on the liquid crystal panel 10 become equal to each other and voltages applied to each liquid crystal pixel become the same with respect to a video data having the same gray level (i.e., the same logical value). Accordingly, a flicker and a residual image does not appear at the liquid crystal panel 10 and, furthermore, a picture is not distorted.

The CPU 20 supplies the processed image data to the controller 22. Then, the controller 22 supplies the image data from the CPU 20 commonly to the j source driver ICs DIC1 to DICj within the data side drive circuit 14 and, simultaneously, supplies various timing signals to the scanning side drive circuit 12, the source driver ICs DIC1 to DICj within the data side drive circuit 14 and the variable reference voltage generator 24. Accordingly, each source driver IC DIC1 to DICj converts a video data from the controller 22 into a positive(+) or negative(−) source signal having an analog signal shape with the aid of the gamma voltage sets from the gamma voltage generator 16 and applies the converted source signal to the source line SL.

Figure 10:
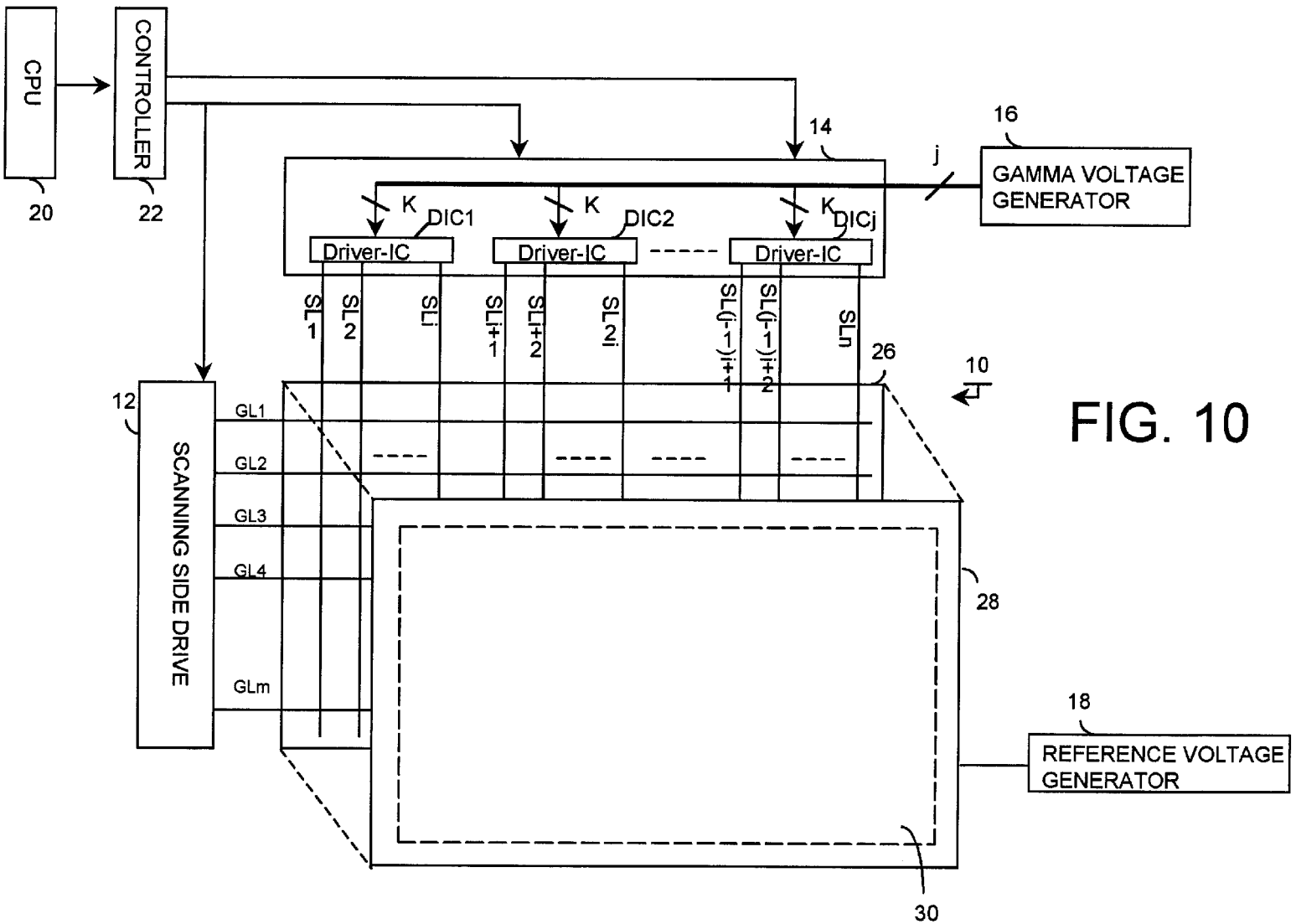
FIG. 10 is a schematic view showing the configuration of an active matrix liquid crystal display apparatus according to a fourth embodiment of the present invention.

FIG. 10 is a schematic view of a liquid crystal display apparatus with a flicker elimination function according to a fourth embodiment of the present invention. In FIG. 10, the liquid crystal display apparatus includes a liquid crystal panel 10 in which gate lines GL1 to GLm and source lines SL1 to SLn are formed on a first transparent substrate 26 in such a manner to cross each other and a reference electrode 30 is formed, in a plate shape, on a second transparent substrate 28 opposed to the first transparent substrate 26. Pixel electrodes (not shown) are connected, via the source terminals and the drain terminals of TFTs, to the source line SL1 to SLn, respectively. The gate terminals of the TFTs are connected to the gate line GL1 to GLm, respectively. The reference electrode 30 and the pixel electrodes apply a longitudinal electric field to the liquid crystal cells.

The liquid crystal display apparatus further includes a gate side drive circuit 12 connected to the gate lines GL1 to GLm, and a data side drive circuit 14 connected to the source lines SL1 to SLn. The gate side drive circuit 12 sequentially applies a scanning signal to m gate lines GL1 to GLm to drive pixels on the liquid crystal panel 10 sequentially for one line.

Figure 11:
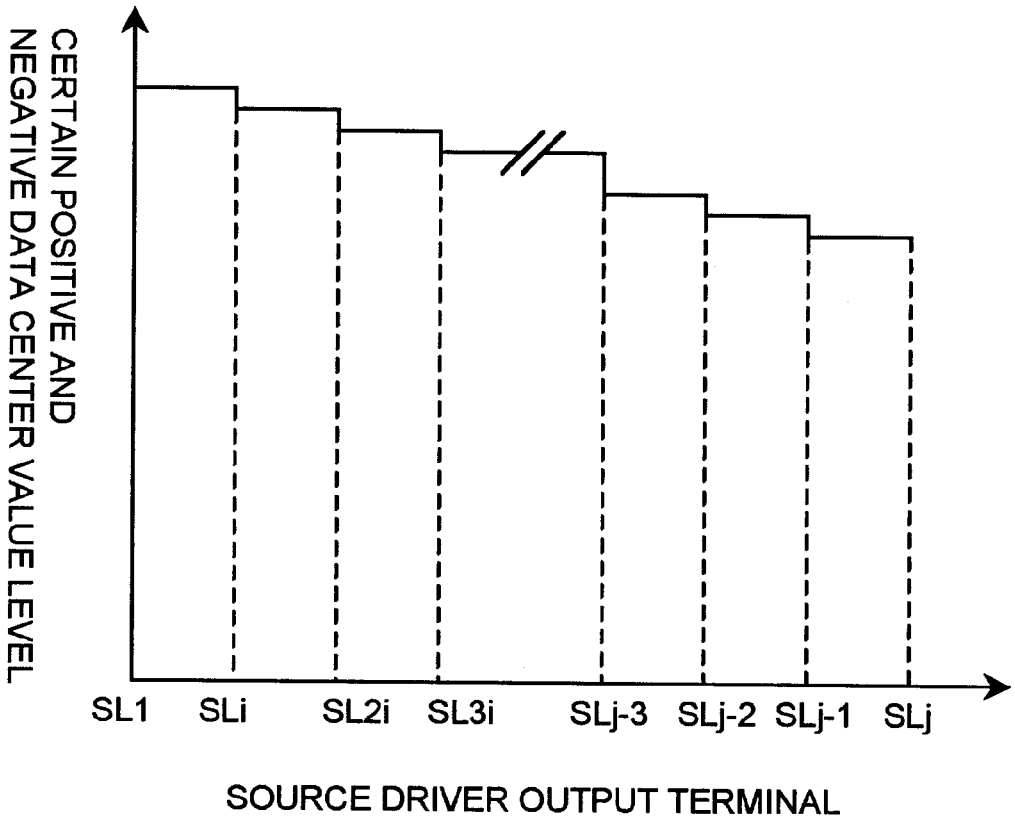
FIG. 11 is a graph showing a change in a center voltage level between positive(+) and negative(−) source signals applied from the data side drive circuit in FIG. 10 for each source line group.

The data side drive circuit 14 applies a source voltage signal to each of n source lines SL1 to SLn each time the scanning signal is applied to any one of the gate lines GL1 to GLm. Further, the data side drive circuit 14 divides the n source lines SL1 to SLn into j line groups, each including i source lines. The data side drive circuit 14 allows a center voltage level between the positive(+) and negative(−) source signals expressing a certain amount of gray levels to become gradually smaller as shown in FIG. 11 as it goes from the first line group to the jth line group.

The data side drive circuit 14 includes j source driver integrated circuits(ICs) DIC1 to DICj that are connected to the j source line groups, respectively, to divisionally receive j gamma voltage signal sets from a gamma voltage generator 16. Each j gamma voltage signal set consists of k gamma voltage signals which are set to have a gradually lower value as it goes from the first gamma voltage set to the jth gamma voltage set, that is, depending upon the source driver ICs DIC1 to DICj.

In order to generate the j gamma voltage sets, the gamma voltage generator 16 consists of j gamma voltage generating cells for each generating k gamma voltage signals. As described above, the respective j source driver ICs DIC1 to DICj divisionally receiving the gamma voltage sets having different voltage level steps generate a source signal in which the center voltage level between the positive(+) and negative(−) voltage levels gradually decreases, with respect to a video data having the same logical value. In other words, when the same logical value of data is displayed for all the pixels on the lines, the center voltage level between the positive(+) and negative(−) source signals applied from the first source driver IC DIC1 to the first source line group SL1 to SLi becomes higher than the center voltage levels of source signals applied to other source line groups SLi+1 to SLn. The center voltage level between the positive(+) and negative(−) source signals applied from the second source driver IC DIC2 to the second source line group SLi+1 to SL2i becomes lower than the center voltage level between the positive(+) and negative(−) source signals applied to the first source line group SL1 to SLi and higher than the center voltage level between the positive(+) and negative(−) source signals applied to the third source line group SL2i+1 to SL3i. The center voltage level between the positive(+) and negative(−) source signals applied from the jth source driver IC DICj to the jth source line group SL(j−1)i+1 to SLn becomes lower than the center voltage levels of source signals applied to other source line groups SL(j−2)i+1 to SL(j−1)i.

As a result, the center voltage level between the positive (+) and negative(−) source signals generating at each j source driver IC DIC1 to DICj becomes gradually lower as it goes from the first line group SL1 to SLi to the jth line group SL(j−1)i+1to SLn. These j source driver ICs compensate for a difference in the feedthrough voltage ΔVp generated at a picture for one line due to a delay of scanning signal at the gate line GL.

Furthermore, the liquid crystal display apparatus includes a reference voltage generator 18 connected to the reference electrode 28, a CPU 20 for processing an image data, and a controller 22 connected among the CPU 20, the scanning side drive circuit 12 and the data side drive circuit 14. The reference voltage generator 18 applies a reference voltage signal to the reference electrode 28. The reference voltage signal generated at the reference voltage generator 18 has a constant voltage level.

As described above, the center value of positive and negative data in the source signal becomes gradually low depending upon the source lines SL, so that the feedthrough voltages ΔVp at all the pixels on the liquid crystal panel 10 become equal to each other and voltages applied to each liquid crystal pixel become the same with respect to a video data having the same gray level (i.e., the same logical value). Accordingly, a flicker and a residual image does not appear at the liquid crystal panel 10 and, furthermore, a picture is not distorted.

The CPU 20 supplies the processed image data to the controller 22. Then, the controller 22 supplies the image data from the CPU 20 commonly to the j source driver ICs DIC1 to DICj within the data side drive circuit 14 and, simultaneously, supplies various timing signals to the scanning side drive circuit 12 and the source driver ICs DIC1 commonly to DICj within the data side drive circuit 14. Consequently, each source driver IC DIC1 to DICj converts a video data from the controller 22 into a positive(+) or negative(−) source signal having an analog signal shape with the aid of the gamma voltage sets from the gamma voltage generator 16 and applies the converted source signal to the source line SL.

FIG. 12 is a detailed circuit diagram of an embodiment of the variable reference voltage generator 24 shown in FIG. 8. In FIG. 12, the variable reference voltage generator 24 includes (m+1) resistors R1 to Rm+1 connected in series between a supply voltage line VSSL and a ground voltage line GNDL, and m control switch SW1 to SWm that are connected to m nodes between the (m+1) resistors R1 to Rm+1, respectively, and connected commonly to an output line 31. The resistors R1 to Rm+1 voltage divide a supply voltage VCC applied between the supply voltage line VCCL and the ground voltage line GNDL to generate m divided voltages. The m divided voltages have any one of the voltage levels increasing gradually.

Accordingly, the lowest divided voltage is supplied to the first control switch SW1, the next lowest divided voltage to the second control switch SW2, and the highest divided voltage to the mth control switch SWm. The first to mth control switches SW1 to SWm are sequentially turned on once every one frame interval by means of m switching signals from a ring counter 30 or other suitable trigger circuits known to one of ordinary skill in the art. The ring counter 30 is preferably initialized every frame by a vertical synchronous signal VSYNC and thereafter allows a specific logic to be moved from the first switching control signal into the nth switching control signal. As a result, a reference voltage signal raised by the predetermined voltage level every horizontal synchronization interval is generated at the output line 31. The reference voltage signal on the output line 31 is applied to the reference voltage line CL in FIG. 8, thereby compensating for a difference in the feedthrough voltage $\Delta Vp$ at pixels connected to a certain source line SL.

Figure 13:
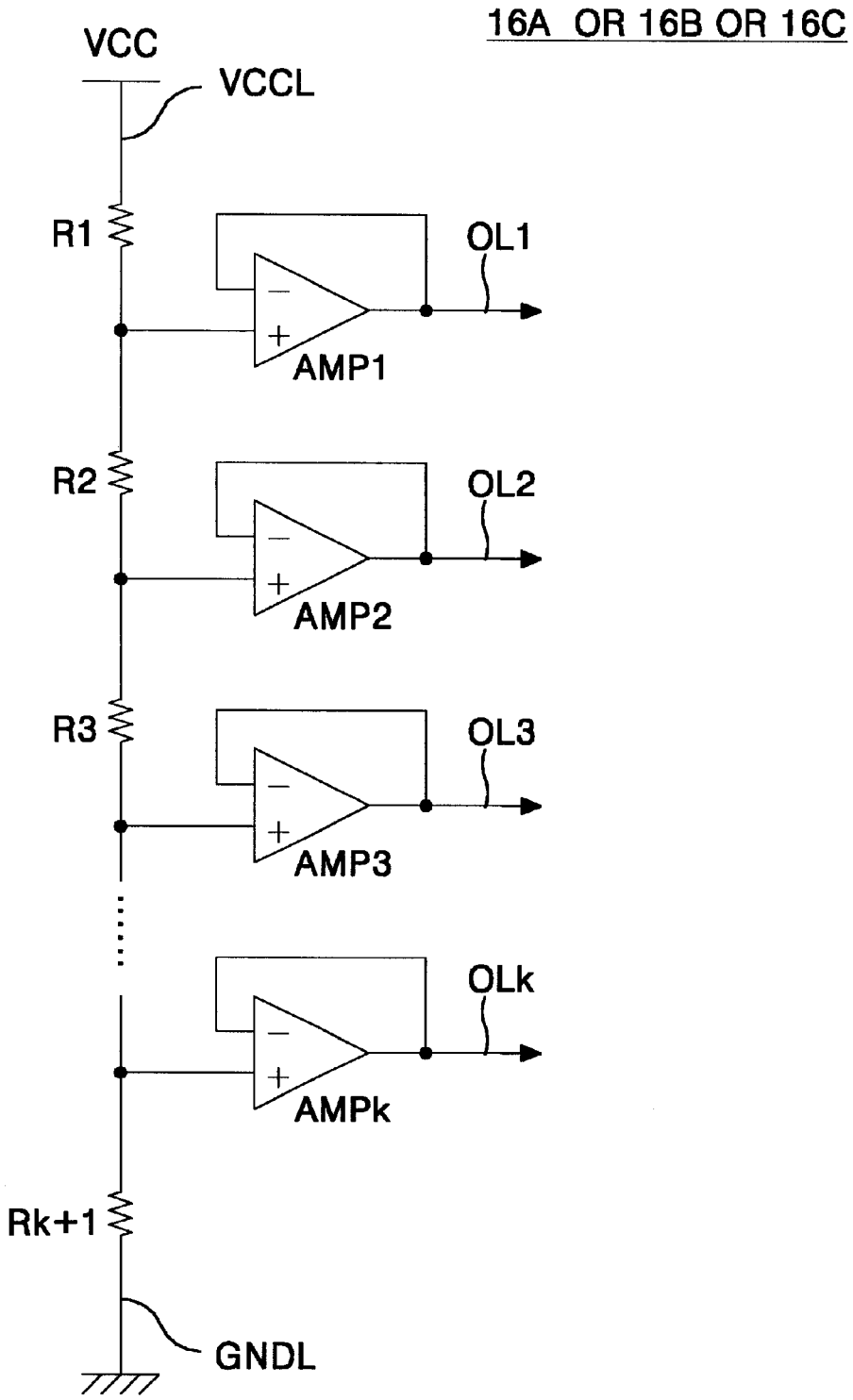
FIG. 13 is a circuit diagram of the gamma voltage generating cell as shown in FIG. 7.

FIG. 13 is a detailed circuit diagram of an embodiment of the gamma voltage generating cell 16A, 16B or 16C shown in FIG. 7 and the gamma voltage generating cell included in the gamma voltage generator shown in FIGS. 5, 8 and 10. In FIG. 13, the gamma voltage generating cell includes (k+1) resistors R1 to Rk+1 connected in series between a supply voltage line VSSL and a ground voltage line GNDL, and current amplifiers AMP1 to AMPk that are connected to k nodes between the (k+1) resistors R1 to Rk+1, respectively. The resistors R1 to Rk+1 voltage divide a supply voltage VCC applied between the supply voltage line VCCL and the ground voltage line GNDL to generate k divided voltages. The k divided voltages have any one of the voltage levels increasing gradually. Accordingly, the lowest divided voltage is supplied to the first current amplifier AMP1, the next lowest divided voltage to the second current amplifier AMP2, and the highest divided voltage to the kth current amplifier AMPk. The first to kth current amplifiers AMP1 to AMPk each amplifies the current amount of the divided voltage signal. The k divided voltage signals from the first to kth current amplifiers are applied to the resistor bus RB in FIG. 7 and the source driver IC DIC in FIGS. 5, 8 and 10 through each output line OL1 to OLk, as a gamma voltage signal set.

As described above, in the liquid crystal display apparatus according to the present invention, both the source voltage signal applied to the source line and the reference voltage signal applied to the reference voltage line are gradually changed. Accordingly, when a source signal having the same gray level must be applied to at least two pixels in on the liquid crystal panel, a difference between the positive and negative data center value of the source signal at each pixel and the reference voltage signal becomes different to thereby compensate for a difference in the feedthrough voltage $\Delta Vp$ at each pixel. As a result, the liquid crystal display apparatus according to the present invention is capable of preventing an emergence of the flicker and the residual image as well as a distortion of the picture displayed on the liquid crystal panel.

Although the present invention has been explained by the embodiments shown in the drawing hereinbefore, it should be understood to the ordinary skilled person in the art that the invention is not limited to the embodiments, but rather that various changes or modifications thereof are possible without departing from the spirit of the invention. For example, although changing the reference voltage signal and the source voltage signal for a certain number of pixels (i.e., I pixels) has been explained as the embodiments, it should be understood to the ordinary skilled person in the art that the magnitude of reference voltage signal and the gain of source voltage signal may be controlled for the pixel unit. Accordingly, the scope of the invention shall be determined only by the appended claims and their equivalents.

What is claimed is:

1. A liquid crystal display comprising:

a data driver;

a plurality of data lines connected to the data driver;

a gate driver;

a plurality of gate lines connected to the gate driver; and a voltage generator coupled to the data driver to compensate input signals to the plurality of data lines, wherein the voltage generator provides a first offset voltage to a first one of the plurality of data lines and provides a second offset voltage to a second one of the plurality of data lines, in which the first and second ones of the plurality of data lines are spatially separated with the first one being closer to the gate driver than the second one, and wherein the first offset voltage differs from the second offset voltage in response to a separation distance between the first one and second one of the plurality of data lines when the first and second data lines input an identified gray level of data; wherein the reference voltage generator is connected to a first location of the shared line and generates higher reference voltages as gate lines that are spatially farther away from the data driver are enable.

2. The liquid crystal display of claim 1, further including a reference voltage generator having an output connected to a plurality of output lines through a shared line, wherein the output lines are extended from the shared line in substantially parallel to the plurality of gate lines.

3. The liquid crystal display of claim 2, wherein the reference voltage generator includes:

a counter; and a voltage divider connected between a first voltage and a second voltage and further connected to the counter to output different voltages in response to the counter.

4. The liquid crystal display of claim 2, wherein the voltage generator allows a difference between a positive and negative data center value of a source signal applied to each of at least two liquid crystal cells and a reference voltage signal from the reference voltage generator when a source signal having the same gray level is applied to the at least two liquid crystal cell to have a different value.

5. The liquid crystal display of claim 1, wherein when the input signals to the first and second ones of the plurality of data lines are substantially identical, the first and second ones of the plurality of data lines compensated by the first and second offset voltages.

6. The liquid crystal display of claim 1, wherein the first voltage offset is less than the second voltage offset.

7. The liquid crystal display of claim 6, wherein the voltage generator provides a third offset voltage to a third one of the plurality of data lines, wherein the third one of the plurality of data lines is closer to the gate driver than both the first and second ones of the plurality of data lines, and wherein the third voltage offset is greater than the second voltage offset.

8. A display method for a liquid crystal display, comprising the steps of:

providing a data driver;

providing a plurality of data lines connected to the data driver;

providing a gate driver;

providing a plurality of gate lines connected to the gate driver; and providing a voltage generator coupled to the data driver to compensate input signals to the plurality of data lines, wherein the voltage generator provides a first offset voltage to a first one of the plurality of data lines and provides a second offset voltage to a second one of the plurality of data lines, in which the first and second ones of the plurality of data lines are spatially separated with the first one being closer to the gate driver than the second one, and wherein the first offset voltage differs from the second offset voltage in response to a separation distance between the first one and second one of the plurality of data lines when the first and second data lines input an identified gray level of data; wherein the reference voltage generator is connected to a first location of the shared line and generates higher reference voltages as gate lines that are spatially farther away from the data driver are enabled.

9. The display method of claim 8, further providing a reference voltage generator having an output connected to a plurality of output lines through a shared line, wherein the output lines are extended from the shared line in substantially parallel to the plurality of gate lines.

10. The display method of claim 9, wherein the voltage generator allows a difference between a positive and negative data center value of a source signal applied to each of at least two liquid crystal cells and a reference voltage signal from the reference voltage generator when a source signal having the same gray level is applied to the at least two liquid crystal cell to have a different value.

11. The display method of claim 9, wherein the reference voltage generator includes:

a counter; and a voltage divider connected between a first voltage and a second voltage and further connected to the counter to output different voltages in response to the counter.

12. The display method of claim 9, wherein the first voltage offset is less than the second voltage offset.

13. The liquid crystal display of claim 12, wherein the voltage generator provides a third offset voltage to a third one of the plurality of data lines, wherein the third one of the plurality of data lines is closer to the gate driver than both the first and second ones of the plurality of data lines, and wherein the third voltage offset is greater than the second voltage offset.

* * * * *